US006450244B1

(12) United States Patent
Bassilakis

(10) Patent No.: US 6,450,244 B1
(45) Date of Patent: Sep. 17, 2002

(54) AIR-TO-AIR HEAT RECOVERY SYSTEM

(76) Inventor: Harry C. Bassilakis, 277 Chimneysweep Hill Rd., Glastonbury, CT (US) 06033

( * ) Notice: Subject to any disclaimer, the term of this patent is extended or adjusted under 35 U.S.C. 154(b) by 0 days.

(21) Appl. No.: 09/970,808

(22) Filed: Oct. 4, 2001

Related U.S. Application Data

(60) Provisional application No. 60/238,141, filed on Oct. 6, 2000.

(51) Int. Cl.[7] ..... F28D 17/00

(52) U.S. Cl. ..... 165/4; 165/9.3; 165/10; 165/59; 165/66

(58) Field of Search ..... 165/4, 10, 59, 165/66, 9.3

(56) References Cited

U.S. PATENT DOCUMENTS

| | | | | | |
|---|---|---|---|---|---|
| 1,920,885 | A | * | 8/1933 | Petit | 165/9.3 |
| 3,058,723 | A | | 10/1962 | Nilsson et al. | 257/270 |
| 3,069,527 | A | | 12/1962 | Kovacik | 219/38 |
| 3,225,819 | A | | 12/1965 | Stevens | 165/2 |
| 3,532,856 | A | | 10/1970 | Collins | 219/325 |
| 3,656,542 | A | * | 4/1972 | Darm | 165/59 |
| 3,666,007 | A | * | 5/1972 | Yoshino et al. | 165/59 |
| 3,692,095 | A | | 9/1972 | Fleming | 165/4 |
| 4,049,404 | A | | 9/1977 | Johnson | 55/387 |
| 4,109,705 | A | * | 8/1978 | Bergdahl | 165/29 |
| 4,228,847 | A | | 10/1980 | Lindahl | 165/10 |
| 5,348,077 | A | * | 9/1994 | Hillman | 165/59 |
| 5,826,641 | A | | 10/1998 | Bierwirth et al. | 165/48.1 |
| 6,129,139 | A | * | 10/2000 | De Clerc | 165/9.3 |
| 6,178,966 | B1 | | 1/2001 | Breshears | 126/702 |
| 6,253,833 | B1 | | 7/2001 | Köster et al. | 165/10 |
| 6,257,317 | B1 | | 7/2001 | DeGregoria et al. | 165/8 |

* cited by examiner

*Primary Examiner*—Henry Bennett
*Assistant Examiner*—Terrell McKinnon
(74) *Attorney, Agent, or Firm*—Alix, Yale & Ristas, LLP

(57) ABSTRACT

An air-to-air heat recovery system for use with a building ventilation system includes first and second heat exchange banks and at least one damper module. Each damper module includes a damper disposed within a substantially rectangular housing having first, second, third, and fourth ports. The first port is connected to the ventilation system exhaust line, the second port is connected to the ventilation system supply line, the third and fourth ports are connected to the first ends of the first and second heat exchange banks, respectively. The damper is periodically reciprocated between first and second positions, directing air flow between the first port and the third port and between the second port and the fourth port in the first position, and directing air flow between the first port and the fourth port and between the second port and the third port in the second position. The second end of each heat exchange bank is connected to the outside such that substantially no stale air is drawn into the supply line when the damper is reciprocated.

20 Claims, 7 Drawing Sheets

AIR-TO-AIR HEAT RECOVERY SYSTEM

RELATED APPLICATION

This application claims the benefit under 35 U.S.C. § 119(e) of U.S. Provisional Patent Application Serial No. 60/238,141 filed Oct. 6, 2000.

BACKGROUND OF THE INVENTION

This invention relates generally to building ventilation systems. More particularly, the present invention relates to building ventilation systems having apparatus for recovering the heat in the air exhausted from the ventilated area.

Ventilating systems are commonly used to maintain indoor environmental standards in industrial buildings, commercial office buildings, schools and farming facilities. Such buildings include foundries, factories, metal finishing areas, work shops, service areas, warehouses, meeting halls, recreational buildings, animal nursery and feeder houses, swimming pools and other facilities of many diverse types. Ventilation systems for such facilities are necessary to remove excess heat, discharge pollutants and unwanted moisture and to maintain a healthful, comfortable environment. Unfortunately, safety, health and economic considerations are at odds with one another in that air, which has been heated or cooled at substantial expense, is virtually thrown away by the conventional ventilation process.

In the case of a heated facility, the exhaust air of the ventilation process contains not only the sensible energy expended in increasing the supply air temperature but the latent energy represented by the vaporized water required to adequately humidify. With great pressure on power-producing utilities and the ever-increasing cost of fuels for heating and cooling, there is a great need to recover thermal energy from the exhaust air of all high performance ventilation systems.

Conventional ventilation thermal energy recovery systems have used rotating wheel heat exchangers as well as non-rotating cross-flow heat exchangers. Heat exchangers of these types have been constructed from metals such as stainless steel and aluminum and from certain ceramics such as aluminum oxide and silicon carbide. Such materials, while structurally sound, are expensive and have little or no capability of storing and releasing moisture not to mention the high maintenance required and lack of ability to provide free cooling when energy is not required to be recovered.

SUMMARY OF THE INVENTION

Briefly stated, the invention in a preferred form is an air-to-air heat recovery system for use with a building ventilation system. The heat recovery system is adapted for installation anywhere on or within the building and comprises first and second heat exchange banks and at least one damper module. Each of the heat exchange banks includes at least one heat exchange module having a heat exchange mass. Each heat exchange bank forms a flow path having oppositely disposed first and second ends. Each damper module includes a damper disposed within a substantially rectangular housing having first, second, third, and fourth ports. The first port is connected to the air exhaust line of the ventilation system, the second port is connected to the air supply line of the ventilation system, the third port is connected to the first end of the first heat exchange bank, and the fourth port is connected to the first end of the second heat exchange bank. The damper is periodically reciprocated between first and second positions, directing air flow between the first port and the third port and between the second port and the fourth port in the first position, and directing air flow between the first port and the fourth port and between the second port and the third port in the second position. The second end of each heat exchange bank is connected to the outside such that substantially no stale air is drawn into the air supply line when the damper is reciprocated.

The heat exchange mass of each heat exchange module includes a plurality of corrugated aluminum plates defining parallel 4 mm flow channels. A housing composed of steel surrounds the heat exchange mass and is separated from the heat exchange mass by an electrically non-conductive lining.

If the heat exchanger is to be installed on the outside of the building, the second end of each heat exchange bank is receives fresh air from the outside without any intervening ducting.

If the heat exchanger is to be installed on the inside of the building with one of the heat exchange banks receiving fresh air from the outside without any intervening ducting, the heat exchanger further comprises a duct and a second damper module. The duct has first and second ends located at an outside surface of the building and is connected to the second end of the second heat exchange bank at a position intermediate the first and second ends. The second damper module is positioned in the duct proximate to the second end of the second heat exchange bank. The first and second damper modules are simultaneously reciprocated between the first and second positions, with the damper of the second damper module directing air flow between the second port and the third port in the first position and between the first port and the third port in the second position.

If the heat exchanger is to be installed on the inside of the building with neither of the heat exchange banks receiving fresh air from the outside without any intervening ducting, the heat exchanger further comprises first and second ducts and second and third damper modules. Each of the ducts has first and second ends located at an outside surface of the building. The first duct is connected to the second end of the first heat exchange bank at a position intermediate the first and second ends and the second duct is connected to the second end of the second heat exchange bank at a position intermediate the first and second ends. The second damper module is positioned in the second duct proximate to the second end of the second heat exchange bank and the third damper module is positioned in the first duct proximate to the second end of the first heat exchange bank. The dampers of the first, second and third damper modules are simultaneously reciprocated between the first and second positions, with the damper of the second damper module directing air flow between the first port and the third port in the first position and between the second port and the third port in the second position and the damper of the third damper module directing air flow between the second port and the third port in the first position and between the first port and the third port in the second position.

It is an object of the invention to provide an air-to-air heat recovery system which may be installed anywhere on or within a building.

It is also an object of the invention to provide an air-to-air heat recovery system which has substantially no cross-contamination of the air.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

With reference to the drawings wherein like numerals represent like parts throughout the several figures, an air-to-air heat recovery system in accordance with the present invention is generally designated by the numeral 10. The system 10 is a modular design, having a damper module 12 and a heat exchange module 14, or cassette.

Figure 2:
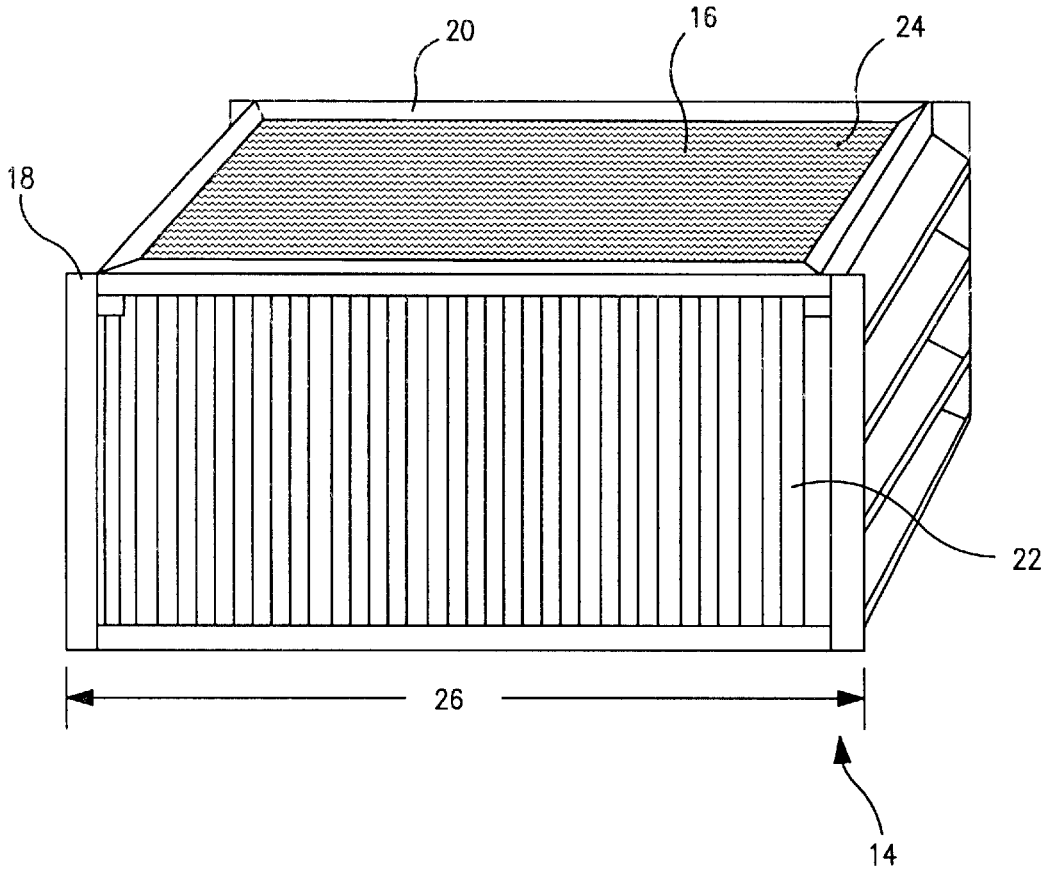
FIG. 2 is a perspective view of one of the heat exchange modules of FIG. 1 with the top wall removed.

With reference to FIG. 2, each heat exchange module 14 includes a heat exchange mass 16 disposed within a rectangular-shaped housing 18. Preferably, the housing 18 has a frame 20 and double-wall 22 construction with oppositely disposed inlet and outlet ends and is composed of galvanized steel. Preferably, the heat-exchange mass 16 is composed of sixty-five corrugated 1100 aluminum plates 24 spaced 4.0 mm apart from each other. The frame 20 is lined with a rubberized material to electrically isolate the steel housing 18 from the aluminum heat exchange mass 16 to eliminate the possibility of galvanic corrosion. The walls 22 may be removed from the frame 20 to allow cleaning of the heat exchange material. The end-to-end length 26 of each module 14 and the spacing between the aluminum plates 24 are selected to produce a pressure drop of less than 0.402 inches for air flows having a velocity of 350 to 546 feet per minute.

Figure 1:
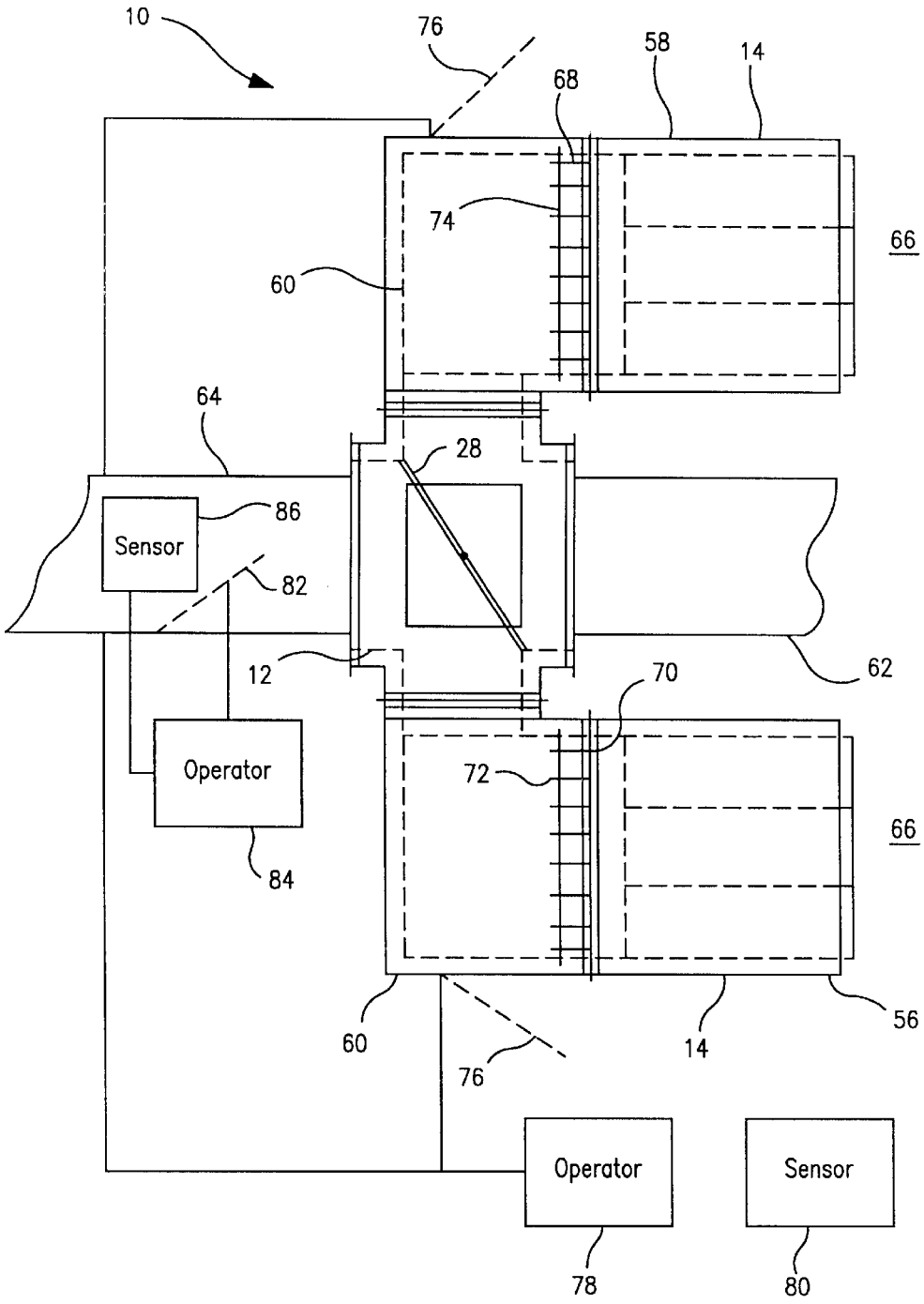
FIG. 1 is a simplified plan view, partly in phantom, of a first configuration of an air-to-air heat recovery system in accordance with the invention.
Figure 3:
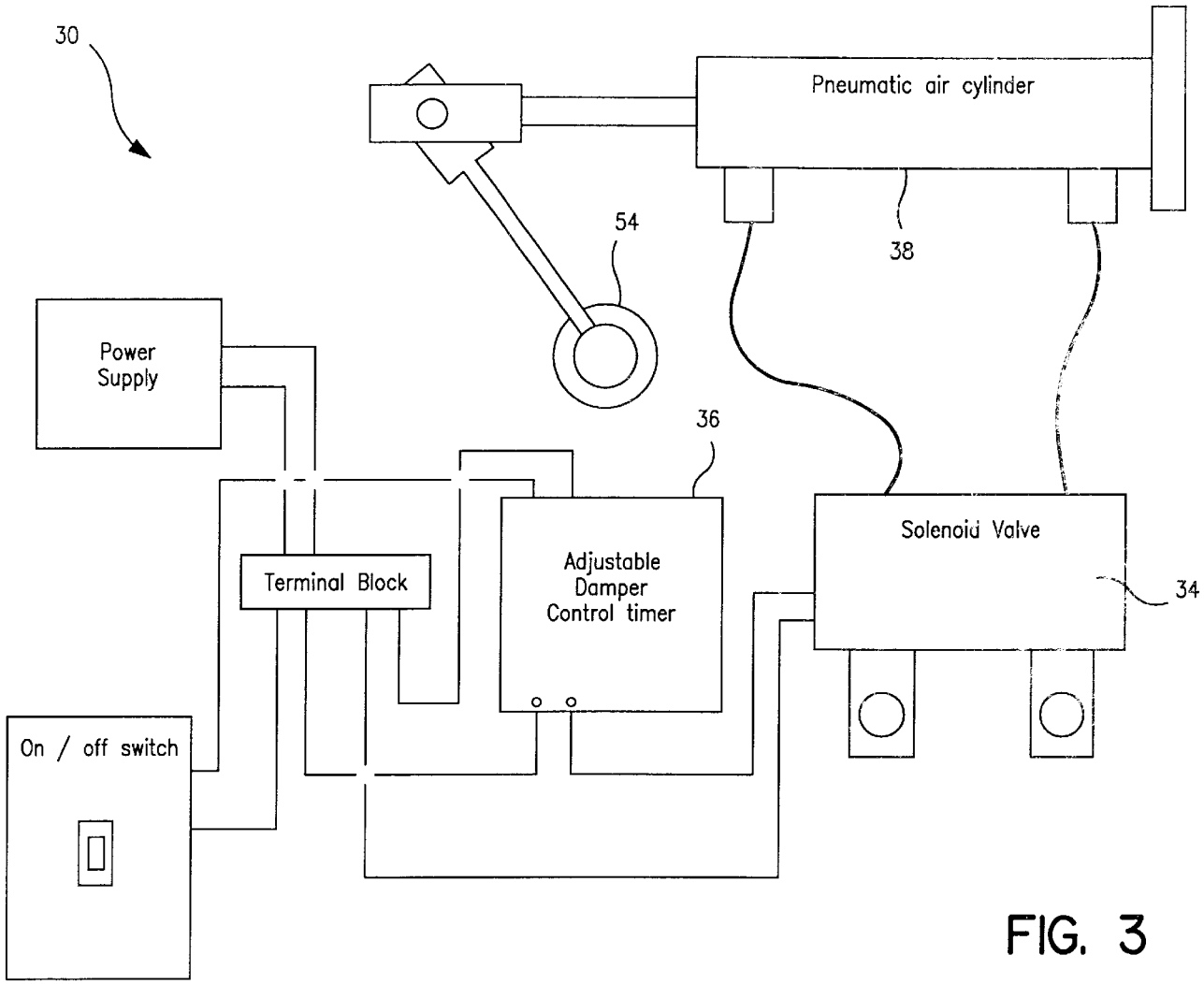
FIG. 3 is a schematic view of the damper control system of FIG. 1.

With reference to FIGS. 1 and 3, each damper module 12 includes a damper 28 and a damper control system 30 disposed within a rectangular-shaped frame 32. A cover is mounted to the top of the frame 32 and the frame 32 is mounted to a base, forming a housing having four sides 44, 46, 48, 50. For the single damper module 12 of the first configuration and the first damper modules 96, 120 of the second and third configurations, all four sides 44, 46, 48, 50 are open and define a port. For the second damper modules 98, 122 of the second and third configurations and the third damper module 124 of the third configuration, the first, second and third sides 44, 46, 48 are open and define a port and the fourth side 50 is closed by a cover 33.

The damper control system 30 includes a solenoid valve 34 which is periodically operated by a timer 36, generally every seventy (70) seconds. Alternatively, the solenoid valve 34 may be operated by a temperature indicator/controller. Air supplied by the solenoid valve 34 actuates a pneumatic air cylinder 38 to reciprocate the damper 28 between first and second positions 40, 42. When the damper 28 is in the first position 40, air flow through the module 12 is directed between the first and third sides 44, 48 and between the second and fourth sides 46, 50. When the damper 28 is in the second position 42, air flow through the module 12 is directed between the first and fourth sides 44, 50 and between the second and third sides 46, 48. All of the damper control system components are mounted on a control unit base plate 52. Removing the base plate mounting screws (not shown) and the damper shaft lock nut 54 allows the entire damper control system 30 to be removed, greatly facilitating maintenance and repair.

The subject system 10 is a reverse flow design, requiring the use of identical, first and second heat exchange banks 56, 58 as explained in greater detail below. Each of the heat exchange banks 56, 58 is composed of one or more heat exchange modules 14, depending on the required heat recovery capacity. The first and second heat exchange banks 56, 58 are combined with one or more damper modules 12 depending on the location of the installation. Conventional ducting 60 is used to connect the modules 12, 14 together and/or to the building ventilation system where necessary.

Figure 4A:
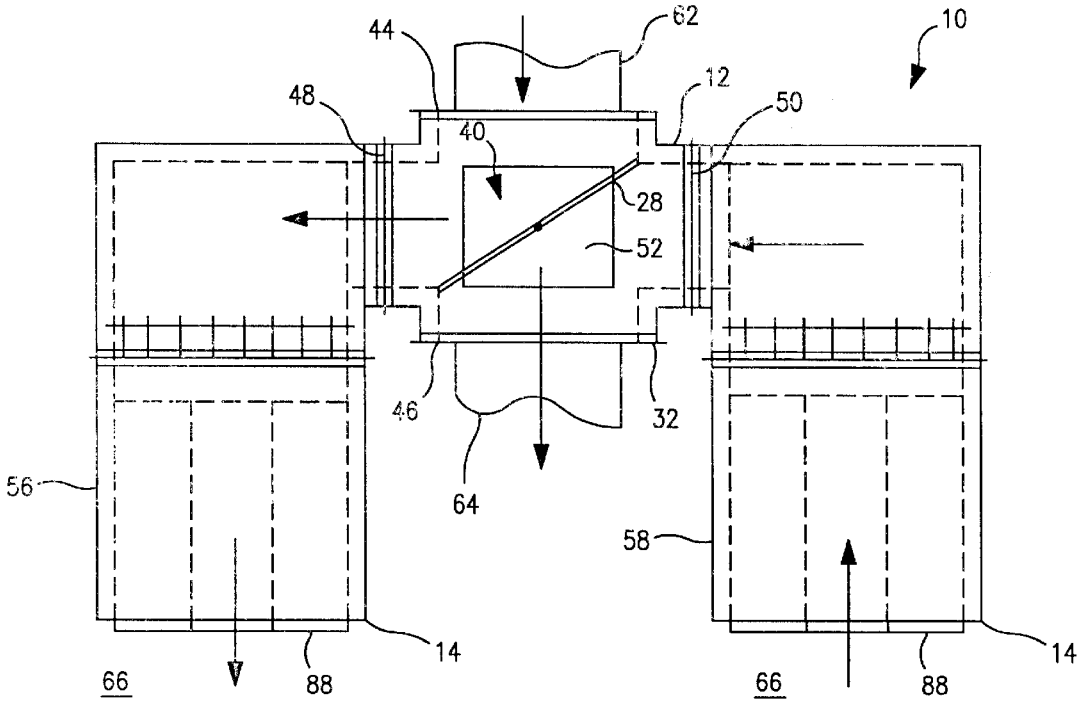
FIGS. 4*a* and 4*b* are simplified plan views of the air-to-air heat recovery system of FIG. 1 illustrating the operating cycle.
Figure 4B:
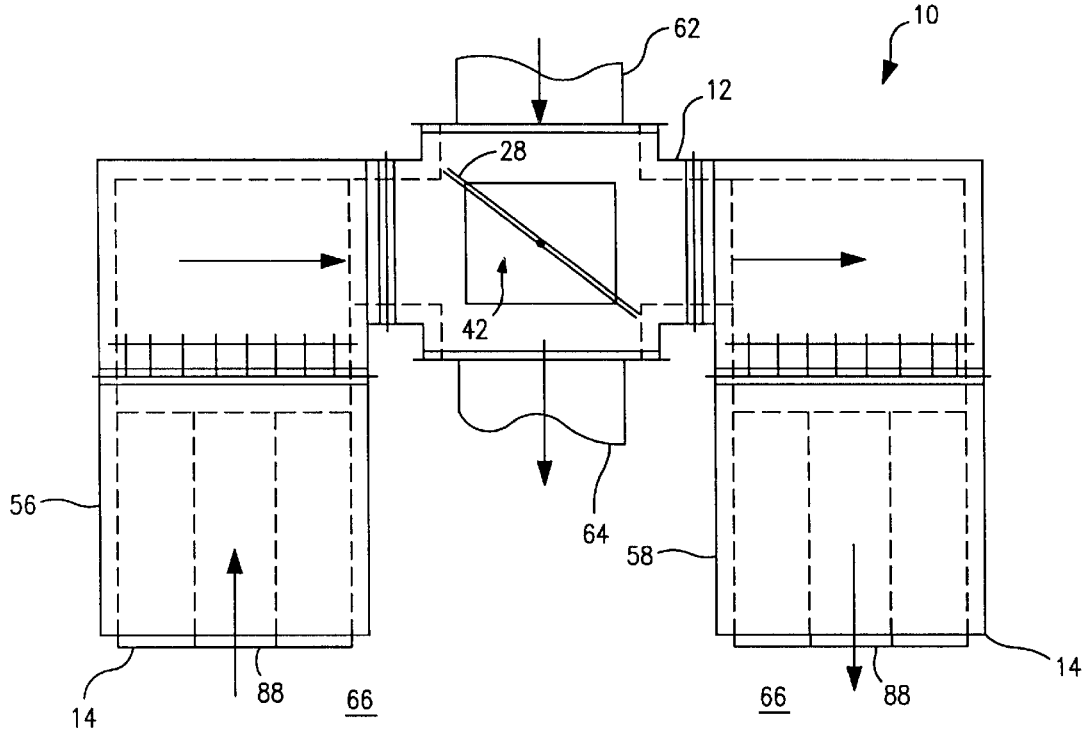

With reference to FIGS. 1, 4*a* and 4*b*, an air-to-air heat recovery system to be mounted on the exterior of the building includes a single damper module 12 disposed intermediate the first and second heat exchange banks 56, 58. The first heat exchange bank 56 is connected to the third side 48 of the damper module 12 and the second heat exchange bank 58 is connected to the fourth side 50 of the damper module 12. If the installation allows, one or more of the heat exchange banks 56, 58 may be connected directly to the damper module 12. Alternatively, the heat exchange banks 56, 58 may be connected to the damper module 1 2 by a section of duct 60, as shown in FIGS. 4*a* and 4*b*. It should be appreciated that one face of the duct 60 is mounted to the damper module 12 and each heat exchange bank 56, 58 may be connected to any one of the other three faces, depending on the installation. The building ventilation exhaust line 62 is connected to the first side 44 of the damper module 12 and the building ventilation supply line 64 is connected to the second side 46 of the damper module 12.

During the first half of the operating cycle (FIG. 4*a*), the damper 28 is positioned at the first position 40, such that the air discharged from the ventilation exhaust duct 62 must travel through the first heat exchange bank 56 before it is finally exhausted to the outside 66. As the air travels through the first heat exchange bank 56, the heat energy in the air is absorbed by the aluminum plates 24 of the heat exchange module(s) 14 which are cool relative to the outgoing air. Outside air that is drawn into the ventilation supply line 64 must travel through the second heat exchange bank 58 before it enters the ventilation supply duct 64. Heat energy that had been absorbed by the aluminum plates 24 in the second half of the previous operating cycle is absorbed by the incoming air which is cool relative to the plates 24.

After the time on the timer 36 has elapsed, the damper 28 is reciprocated to the second position 42 thereby changing the air flow path through the damper module 12 (FIG. 4*b*). During the second half of the operating cycle, the air discharged from the ventilation exhaust line 62 must travel through the second heat exchange bank 58 before it is finally exhausted to the outside 66. As the air travels through the second heat exchange bank 58, the heat energy in the air is absorbed by the aluminum plates 24 of the heat exchange module(s) 14 which had just been cooled by the flow of incoming air in the first half of the operating cycle. Outside air that is drawn into the ventilation supply line 64 must travel through the first heat exchange bank 56 before it enters the ventilation supply duct 64. Heat energy that had been absorbed by the aluminum plates 24 in the first half of the operating cycle is absorbed by the incoming air which is cool relative to the plates 24.

After the time on the timer 36 has elapsed, the damper 28 is reciprocated to the first position 40 thereby initiating the first half of the next cycle (FIG. 4*a*). Alternating the two heat exchange banks 56, 58 between the ventilation exhaust line 62 and the ventilation supply line 64 allows the heat in the outgoing air to be recovered, stored, and returned to the incoming air. It should be appreciated that in cold, winter weather, moisture in the outgoing air condenses on the aluminum plates 24 providing for recovery of latent heat. The short time period between the two halves of the cycle limits the accumulation of ice on the aluminum plates 24 such that the heat of the outgoing air flow is sufficient to defrost the surface of the plates 24.

With reference to FIG. 1, porous desiccant filter veins 68 may be provided intermediate the heat exchange banks 56, 58 and the damper module 12. During hot, summer weather, such veins 68 may be used to dehumidify the incoming supply air while the relatively cool building exhaust can be used to cool the aluminum plates 24, which in turn cool the incoming supply air. Such operation reduces the capacity requirement for the building's other cooling equipment. During cold, winter weather, such veins 68 are placed in the open position such that the air flows past the face surfaces of the veins 68.

Figure 7A:
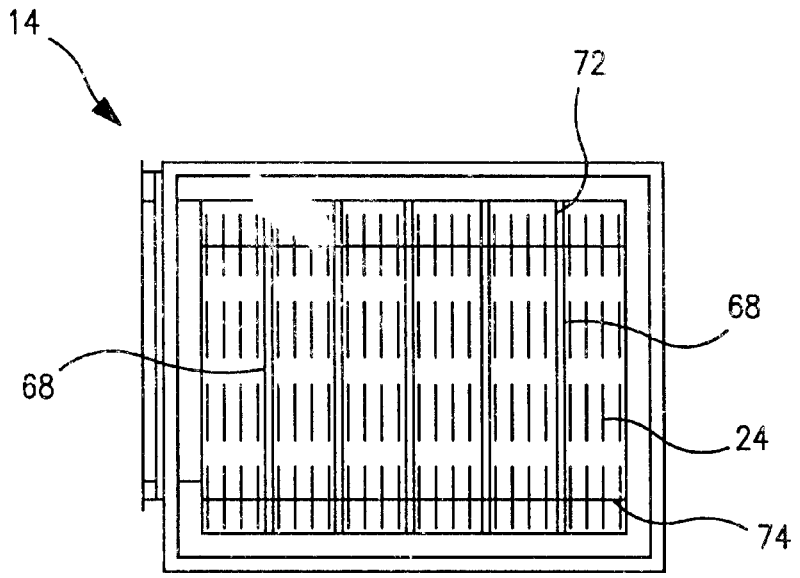
FIGS. 7*a* and 7*b* are front views of the heat exchange cassette and desiccant veins of FIG. 1, illustrating winter and summer modes of operation.
Figure 7B:
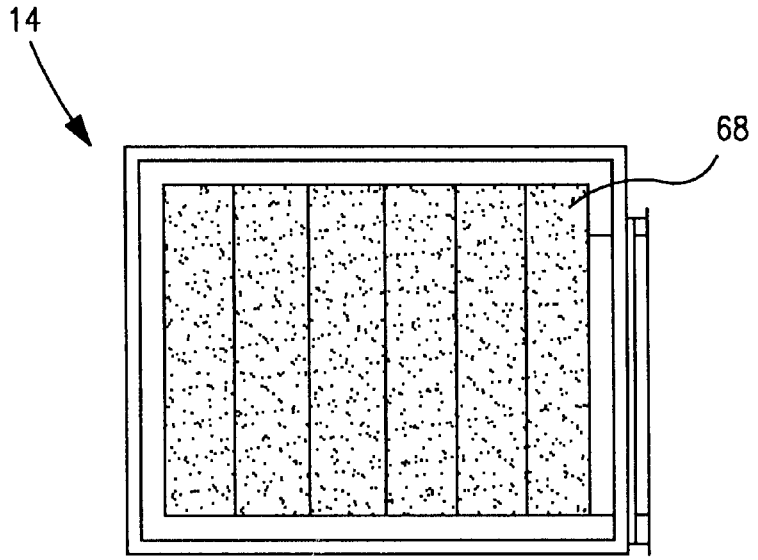

With further reference to FIGS. 1, 7*a* and 7*b*, each desiccant filter vein 68 has an inboard edge 70 pivotally mounted to the heat exchange bank 56, 58 and an outboard edge 72. The outboard edge 72 is positionable by an operator 74 at either an open position, FIGS. 1 and 7*a*, or a closed position, FIG. 7*b*. When the desiccant filter veins 68 are in the open position, air flows past the face surfaces of the veins 68. When the desiccant filter veins 68 are in the closed position, air must flow through the pores of the veins 68 allowing the desiccant material to remove the moisture entrained in the air.

It should be appreciated that the size of the heat exchange banks 56, 58 is determined by the building heat recovery requirements, with each heat exchange bank 56, 58 comprising an identical number of heat exchange modules 14. The building ventilation system is run in an "economizer mode" during the months in which heat recovery is not required. Although the heat exchange module 14 are designed to provide a low flow resistance, this small resistance reduces the efficiency of the building ventilation system when it is in the economizer mode. Bypass vents 76 may be provided intermediate the heat exchange banks 56, 58 and the damper module 12 that open when the ventilation system is in the economizer mode, allowing the incoming and outgoing air flow to bypass the heat exchange banks 56, 58. Preferably, an operator 78 automatically opens and closes the vents depending on the outdoor temperature, as sensed by an outdoor temperature sensor 80.

In certain applications, it is not desirable to recover all of the heat energy of the exhaust air. For example, computer equipment is temperature sensitive and operates most reliably in a space that is maintained at a lower temperature than is generally comfortable for personnel. Air conditioning equipment is bulkier, less efficient, and more difficult to install than heating equipment. Consequently, in buildings containing rooms for computer installations it may be more efficient to maintain the temperature of the supply air at a constant lower temperature suitable for the computer equipment and to heat the portion of the supply air which is routed to rooms which are not devoted to computers. The efficiency of the subject air-to-air heat recovery system 10 is sufficiently high that a flow of unconditioned outside air must be mixed with the supply air heated by the heat exchange bank 56, 58 in order to cool the supply air to the desired temperature. A mixing damper 82 located in the ventilation supply duct 64 is provided for this purpose. Preferably, an operator 84 automatically opens and closes the vents depending on the supply air temperature, as sensed by a temperature sensor 86 in the ventilation supply duct 64 downstream of the mixing damper 82.

Cross-contamination of the supply air occurs when a portion of the exhaust air is returned into the building in the supply air flow. Such cross-contamination is not of concern in many installations because the building ventilation system replaces only portion of the total volume of air in the building. However, cross-contamination is of concern where the building ventilation system must replace the total volume of air, to keep hazardous gasses below allowable levels for example. Cross-contamination is minimal when the air-to-air system 10 is installed exterior to the building because the exhaust/intake 88 of each heat exchange bank 56, 58 effectively defines the boundary between the building interior and the building exterior. However, it is not always possible to install the subject system exterior to the building. In such instances, ducting 60 is required to connect the exhaust/intake 88 of at least one of the heat exchange banks 56, 58 to the building exterior. With a system of the type shown in FIGS. 1, 4*a* and 4*b*, exhaust air transiting such ducting 60 at the time that the damper 28 reciprocates to the other position will be entrained in supply air, resulting in cross-contamination. The two damper configuration shown in FIGS. 5*a* and 5*b* and the three damper configuration shown in FIGS. 6*a* and 6*b* provide cross-contamination free air-to-air heat recovery while allowing installation of the subject system 10 anywhere within a building.

Figure 5A:
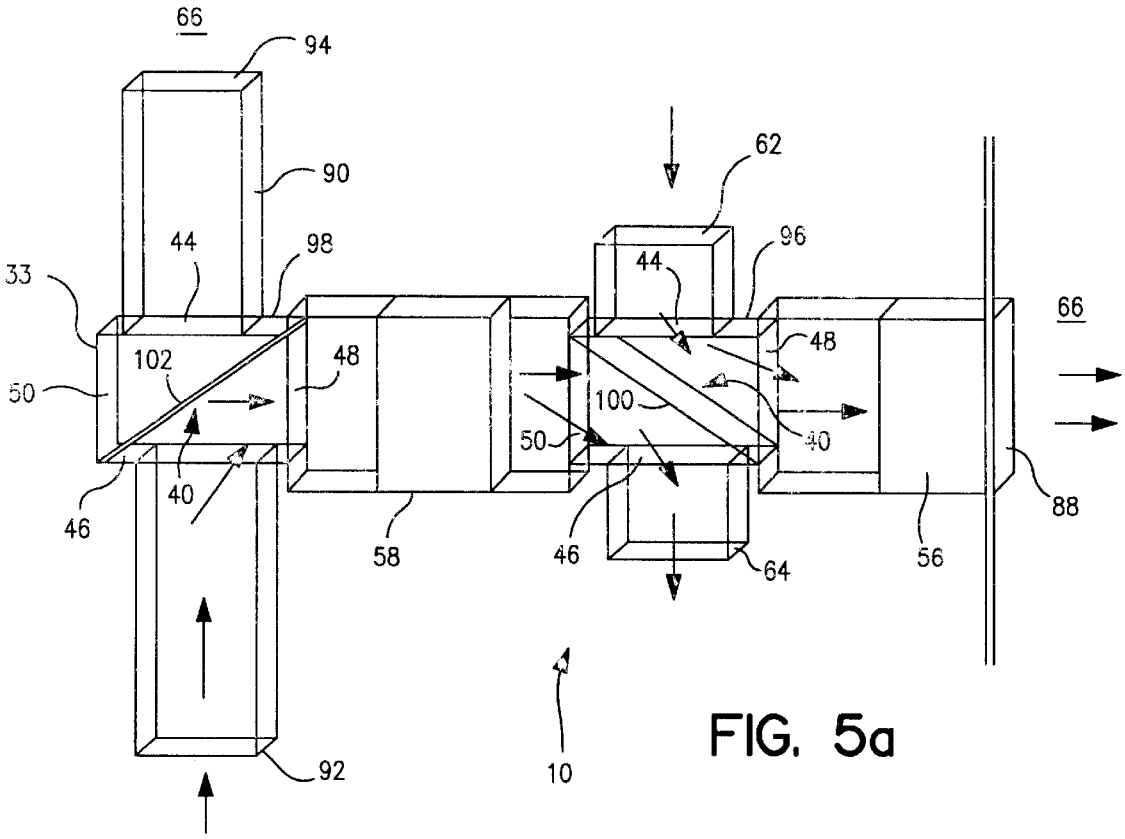
FIGS. 5*a* and 5*b* are simplified plan views of a second configuration of an air-to-air heat recovery system in accordance with the invention, illustrating the operating cycle.
Figure 5B:
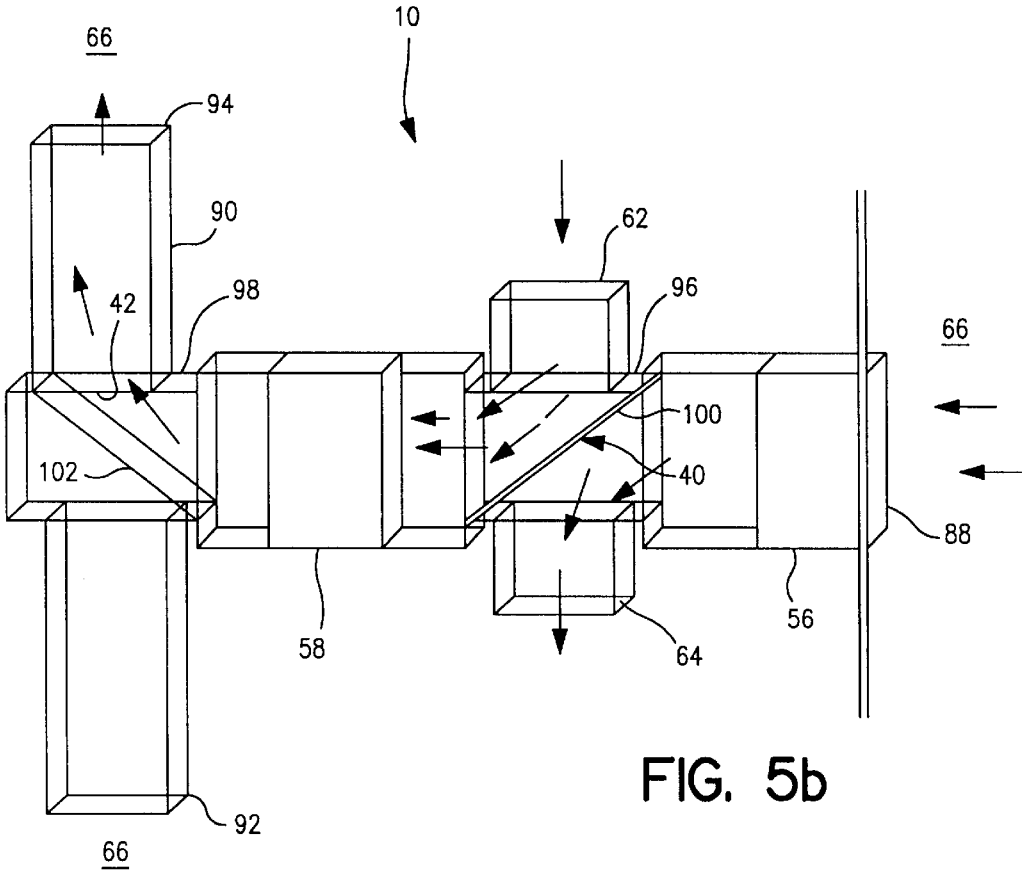
Figure 6A:
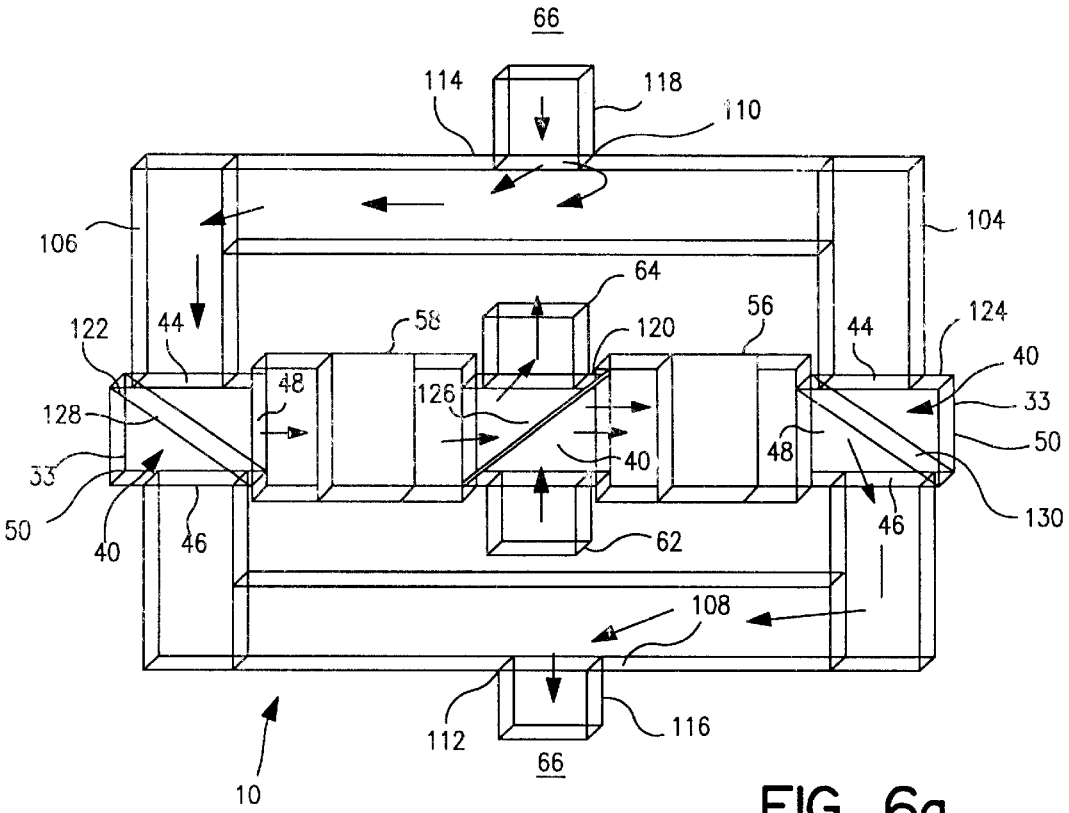
FIGS. 6*a* and 6*b* are simplified plan views of a third configuration of an air-to-air heat recovery system in accordance with the invention, illustrating the operating cycle.
Figure 6B:
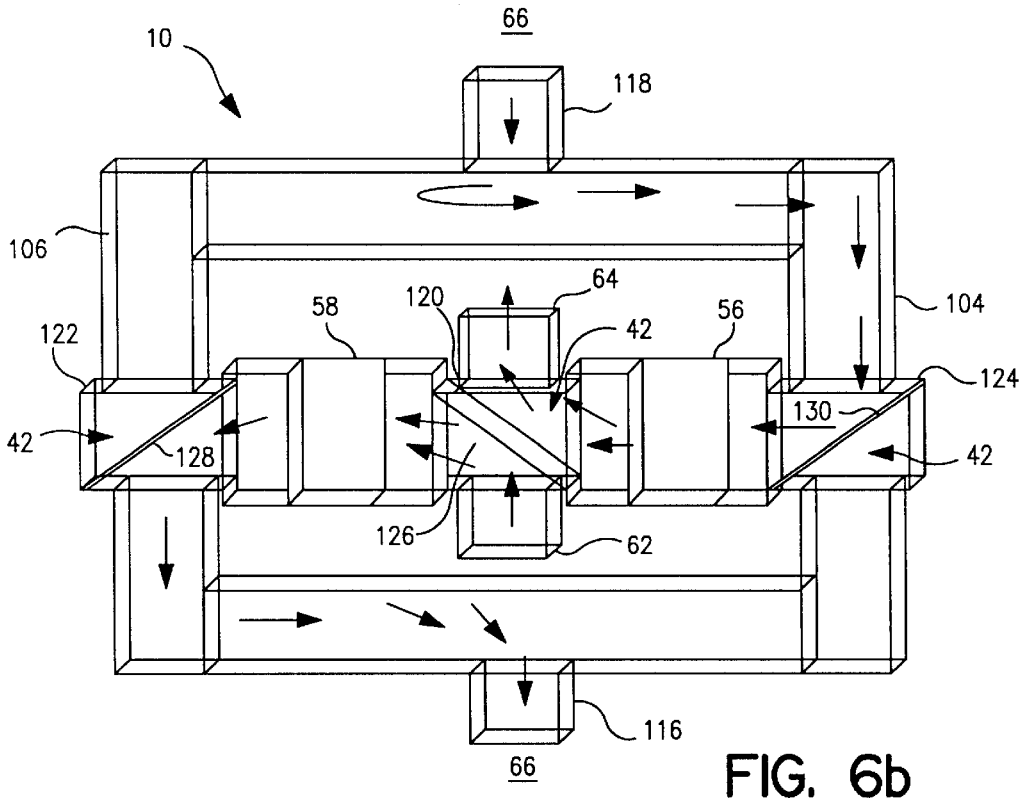

With reference to FIGS. 5*a* and 5*b*, the two damper configuration is used when the exhaust/intake 88 of the first heat exchange bank 56 is located at an outside wall of the building. In this configuration, the second heat exchange bank 58 is connected to the outside air by a duct 90 having first and second ends 92, 94 located at an outside surface of the building. In accordance with ASHRAE recomendations, the first and second ends 92, 94 of the duct 90 should be positioned at least ten feet from the exhaust/intake 88 of the first heat exchange bank 56. There are no minimum distance requirements with respect to the first and second ends 92, 94 of the duct 90. The second damper module 98 is positioned in the duct 90 where the duct 90 is connected to the second heat exchange bank 58.

During the first half of the operating cycle (FIG. 5*a*), the first and second dampers 100, 102 are each positioned at a first position 40, such that the air discharged from the ventilation exhaust line 62 is directed through the first heat exchange bank 56 by the first damper 100, where the heat energy in the air is absorbed, before it is finally exhausted to the outside 66. Outside air is drawn into the first end 92 of the duct 90, directed through the second heat exchange bank 58 by the second damper 102, and directed into the ventilation supply duct 64 by the first damper 100. Heat energy that had been absorbed by the second heat exchange bank 58 in the second half of the previous operating cycle is absorbed by the incoming air.

After the time on the timer 36 has elapsed, the first and second dampers 100, 102 are reciprocated to the second position 42 thereby changing the air flow path through the first and second damper modules 96, 98 (FIG. 5*b*). During the second half of the operating cycle, the air discharged from the ventilation exhaust 62 line is directed by the first damper 100 through the second heat exchange bank 58 and is further directed to the second end 94 of the duct 90 by the second damper 102. As the air travels through the second heat exchange bank 58, the heat energy in the air is absorbed by the heat exchange module(s) 14 which had just been cooled by the flow of incoming air in the first half of the operating cycle. Outside air is drawn through the first heat exchange bank 56, where the heat energy that had been absorbed by the aluminum plates 24 in the first half of the operating cycle is absorbed by the incoming air, and is directed into the ventilation supply duct 64 by the first damper 100. After the time on the timer 36 has elapsed, the first and second dampers 100, 102 reciprocate to the first position 40 thereby initiating the first half of the next cycle (FIG. 5*a*).

With reference to FIGS. 6a and 6b, the three damper configuration is used when both of the heat exchange banks 56, 58 must be located remotely from an outside wall of the building. In this configuration, each heat exchange bank 56, 58 is connected to the outside air by a respective duct 104, 106 having first ends 108, 112 and second ends 110, 114 which are in communication with the outside air. As shown in FIGS. 6a and 6b, the first ends 108, 112 of ducts 104 and 106 may both be connected to the same outside access 116 and the second ends 110, 114 of ducts 104 and 106 may both be connected to the same outside access 118. In accordance with ASHRAE recomendations, outside access 116 and 118 should be positioned at least ten feet from each other. The second damper module 122 is positioned in duct 106 where it is connected to the second heat exchange bank 58 and the third damper module 124 is positioned in duct 104 where it is connected to the first heat exchange bank 56.

During the first half of the operating cycle (FIG. 6*a*), the first, second and third dampers 126, 128, 130 are each positioned at a first position 40, such that the air discharged from the ventilation exhaust line 62 is directed through the first heat exchange bank 56 by the first damper 126, where the heat energy in the air is absorbed, and outside through outside access 116 by the third damper 130. Outside air is drawn through outside access 118, directed through the second heat exchange bank 58 by the second damper 128, and directed into the ventilation supply duct 64 by the first damper 126. Heat energy that had been absorbed by the second heat exchange bank 58 in the second half of the previous operating cycle is absorbed by the incoming air.

After the time on the timer 36 has elapsed, the first, second and third dampers 126, 128, 130 are reciprocated to the second position 42 thereby changing the air flow path through the first, second and third damper modules 120, 122, 124 (FIG. 6*b*). During the second half of the operating cycle, the air discharged from the ventilation exhaust line 62 is directed by the first damper 126 through the second heat exchange bank 58 and is further directed out through outside access 116 by the second damper 128. As the air travels through the second heat exchange bank 58, the heat energy in the air is absorbed by the heat exchange module(s) 14 which had just been cooled by the flow of incoming air in the first half of the operating cycle. Outside air is drawn through outside access 118 and directed through the first heat exchange bank 56 by the third damper 130, where the heat energy that had been absorbed by the aluminum plates 24 in the first half of the operating cycle is absorbed by the incoming air, and is further directed into the ventilation supply duct 64 by the first damper 126. After the time 36 on the timer has elapsed, the first, second and third dampers 126, 128, 130 reciprocate to the first position 40 thereby initiating the first half of the next cycle (FIG. 6*a*).

It should be appreciated that the use of the second damper 102 in the two damper configuration and the use of the second and third dampers 128, 130 in the three damper configuration isolates the ducting 90, 104, 106 containing outgoing air when the associated damper 102, 128, 130 reciprocates to reverse the flow of air through the heat exchange bank. Consequently, there is substantially no cross-contamination of the air supply no matter where the system 10 may be installed.

It should also be appreciated that the subject invention provides a high-performance ventilation system which is capable of supplying air to and exhausting air from a thermally controlled area in a unidirectional flow pattern while at the same time recovering an extremely high percentage of thermal energy, both sensible and latent, from the exhausted air. Accordingly, waste heat from lighting, computers, motors and like devices is utilized. Therefore, the invention makes possible an air-to-air heat recovery system having a low initial cost which can be offset in fuel savings in a very short time.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An air-to-air heat exchanger for use with a building defining an inside and an outside and having a ventilation system including an air exhaust line for discharging stale air from inside and an air supply line for receiving fresh air from the outside, the heat exchanger comprising:

first and second heat exchange banks, each of the heat exchange banks including at least one heat exchange module and defining a flow path having oppositely disposed first and second ends, each of the heat exchange modules including a heat exchange mass; and at least a first damper module, each damper module including a damper disposed within a substantially rectangular housing having four sides defining first, second, third, and fourth ports, the damper being periodically reciprocated between first and second positions, the first port of the first damper module being adapted for connection to the air exhaust line, the second port of the first damper module being adapted for connection to the air supply line, the third port of the first damper module being connected to the first end of the first heat exchange bank, and the fourth port of the first damper module being connected to the first end of the second heat exchange bank, the damper of the first damper module directing air flow between the first port and the third port and between the second port and the fourth port in the first position, the damper of the first damper module directing air flow between the first port and the fourth port and between the second port and the third port in the second position;

wherein the heat exchanger is adapted for installation anywhere on or within the building and the second end of each heat exchange bank is adapted for connection to the outside whereby substantially no stale air is drawn into the air supply line when the damper is reciprocated.

2. The heat exchanger of claim 1 wherein the heat exchange mass of each heat exchange module comprises a plurality of corrugated aluminum plates defining parallel 4 mm flow channels.

3. The heat exchanger of claim 2 wherein the each of the heat exchange modules also includes a housing composed of steel and an electrically non-conductive lining disposed intermediate the heat exchange mass and the housing.

4. The heat exchanger of claim 1 wherein each damper module also includes a damper control system comprising:

a pneumatic air cylinder connected to the damper, a solenoid valve in fluid communication with the pneumatic air cylinder, a timer in electrical communication with the solenoid valve, wherein the timer sends a signal to the solenoid valve at predetermined time intervals, actuating the pneumatic air cylinder with air from the solenoid valve.

5. The heat exchanger of claim 4 wherein the damper module further includes a control unit base plate, all components of the damper control system being mounted to the control unit base plate.

6. The heat exchanger of claim 1 wherein the heat exchanger is adapted for installation on the outside of the building and the second end of each heat exchange bank is adapted for receiving fresh air from the outside without any intervening ducting.

7. The heat exchanger of claim 1 wherein the heat exchanger is adapted for installation on the inside of the building and the second end of the first heat exchange banks is adapted for receiving fresh air from the outside without any intervening ducting, the heat exchanger further comprising a duct and a second damper module, the duct having first and second ends located at an outside surface of the building and being connected to the second end of the second heat exchange bank at a position intermediate the first and second ends, the second damper module being positioned in the duct proximate to the second end of the second heat exchange bank.

8. The heat exchanger of claim 7 wherein the dampers of the first and second damper modules are simultaneously reciprocated between the first and second positions, the damper of the second damper module directing air flow between the second port and the third port in the first position and between the first port and the third port in the second position.

9. The heat exchanger of claim 1 wherein the heat exchanger is adapted for installation on the inside of the building, the heat exchanger further comprising first and second ducts and second and third damper modules, each of the ducts having first and second ends located at an outside surface of the building, the first duct being connected to the second end of the first heat exchange bank at a position intermediate the first and second ends, the second duct being connected to the second end of the second heat exchange bank at a position intermediate the first and second ends, the second damper module being positioned in the second duct proximate to the second end of the second heat exchange bank, the third damper module being positioned in the first duct proximate to the second end of the first heat exchange bank.

10. The heat exchanger of claim 9 wherein the dampers of the first, second and third damper modules are simultaneously reciprocated between the first and second positions, the damper of the second damper module directing air flow between the first port and the third port in the first position and between the second port and the third port in the second position, the damper of the third damper module directing air flow between the second port and the third port in the first position and between the first port and the third port in the second position.

11. The heat exchanger of claim 1 further including a plurality of filter veins composed of porous desiccant material disposed intermediate each of the heat exchange banks and the first damper module.

12. The heat exchanger of claim 11 wherein each filter vein has an inboard edge pivotally mounted to one of the heat exchange banks and an outboard edge, the outboard edge being positionable at either an open position or a closed position.

13. The heat exchanger of claim 12 further including operator means for moving the filter veins between the first and second positions.

14. The heat exchanger of claim 1 further including first and second bypass vents disposed intermediate the first and second heat exchange banks and the first damper module, each of the bypass vents being positionable in an open or a closed position.

15. The heat exchanger of claim 14 further including an outside temperature sensor and operator means in electrical communication with the outside temperature sensor for moving the first and second bypass vents between the open and closed positions.

16. The heat exchanger of claim 1 further including a mixing damper disposed in the air supply line, the mixing damper being positionable in an open or a closed position.

17. The heat exchanger of claim 16 further including a fresh air temperature sensor disposed in the air supply line and operator means in electrical communication with the fresh air temperature sensor for moving the mixing damper between the open and closed positions.

18. An air-to-air heat exchanger for use with a building defining an inside and an outside and having a ventilation system including an air exhaust line for discharging stale air from inside and an air supply line for receiving fresh air from the outside, the heat exchanger comprising:

first and second heat exchange banks, each of the heat exchange banks including at least one heat exchange module and defining a flow path having oppositely disposed first and second ends, each of the heat exchange modules including a heat exchange mass; and a first damper module including a damper disposed within a substantially rectangular housing having four sides defining first, second, third, and fourth ports, the first port being adapted for connection to the air exhaust line, the second port being adapted for connection to the air supply line, the third port being connected to the first end of the first heat exchange bank, and the fourth port being connected to the first end of the second heat exchange bank, the damper being periodically reciprocated between first and second positions, the damper directing air flow between the first port and the third port and between the second port and the fourth port in the first position, the damper directing air flow between the first port and the fourth port and between the second port and the third port in the second position;

wherein the heat exchanger is adapted for installation outside the building whereby substantially no stale air is drawn into the air supply line when the damper is reciprocated.

19. An air-to-air heat exchanger for use with a building defining an inside and an outside and having a ventilation system including an air exhaust line for discharging stale air from inside and an air supply line for receiving fresh air from the outside, the heat exchanger comprising:

first and second heat exchange banks, each of the heat exchange banks including at least one heat exchange module and defining a flow path having oppositely disposed first and second ends, each of the heat exchange modules including a heat exchange mass;

a duct having first and second ends located at an outside surface of the building; and first and second damper modules, each damper module including a damper disposed within a substantially rectangular housing having four sides defining first, second, third, and fourth ports, the damper of each module being simultaneously periodically reciprocated between first and second positions, the first port of the first damper module being adapted for connection to the air exhaust line, the second port of the first damper module being adapted for connection to the air supply line, the third port of the first damper module being connected to the first end of the first heat exchange bank, and the fourth port of the first damper module being connected to the first end of the second heat exchange bank, the second damper module being positioned in the duct intermediate the first and second ends, the first and second ports of the second damper module being connected to the duct, the third port of the second damper module being connected to the second end of the second heat exchange bank, the damper of the first damper module directing air flow between the first port and the third port and between the second port and the fourth port in the first position, the damper of the first damper module directing air flow between the first port and the fourth port and between the second port and the third port in the second position, the damper of the second damper module directing air flow between the second port and the third port in the first position and between the first port and the third port in the second position;

wherein the heat exchanger is adapted for installation within the building whereby substantially no stale air is drawn into the air supply line when the damper is reciprocated.

20. An air-to-air heat exchanger for use with a building defining an inside and an outside and having a ventilation system including an air exhaust line for discharging stale air from inside and an air supply line for receiving fresh air from the outside, the heat exchanger comprising:

first and second heat exchange banks, each of the heat exchange banks including at least one heat exchange module and defining a flow path having oppositely disposed first and second ends, each of the heat exchange modules including a heat exchange mass;

first and second ducts, each of the ducts having first and second ends located at an outside surface of the building; and first, second and third damper modules, each damper module including a damper disposed within a substantially rectangular housing having four sides defining first, second, third, and fourth ports, the damper of each module being simultaneously periodically reciprocated between first and second positions, the first port of the first damper module being adapted for connection to the air exhaust line, the second port of the first damper module being adapted for connection to the air supply line, the third port of the first damper module being connected to the first end of the first heat exchange bank, and the fourth port of the first damper module being connected to the first end of the second heat exchange bank, the second and third damper modules being positioned in the second and first ducts, respectively, intermediate the first and second ends, the first and second ports of the second damper module being connected to the second duct, the third port of the second damper module being connected to the second end of the second heat exchange bank, the first and second ports of the third damper module being connected to the first duct, the third port of the third damper module being connected to the second end of the first heat exchange bank, the damper of the first damper module directing air flow between the first port and the third port and between the second port and the fourth port in the first position, the damper of the first damper module directing air flow between the first port and the fourth port and between the second port and the third port in the second position, the damper of the second damper module directing air flow between the first port and the third port in the first position and between the second port and the third port in the second position, the damper of the third damper module directing air flow between the second port and the third port in the first position and between the first port and the third port in the second position;

wherein the heat exchanger is adapted for installation within the building whereby substantially no stale air is drawn into the air supply line when the damper is reciprocated.

* * * * *